US008824711B1

(12) United States Patent
Durant et al.

(10) Patent No.: US 8,824,711 B1
(45) Date of Patent: Sep. 2, 2014

(54) EFFICIENT CONVEX OPTIMIZATION FOR REAL-TIME ROBUST BEAMFORMING WITH MICROPHONE ARRAYS

(75) Inventors: Eric A. Durant, Milwaukee, WI (US); Ivo Merks, Eden Prairie, MN (US); William S. Woods, Berkeley, CA (US); Jinjun Xiao, Chanhassen, MN (US); Tao Zhang, Eden Prairie, MN (US); Zhi-Quan Luo, Maple Grove, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 178 days.

(21) Appl. No.: 13/276,664

(22) Filed: Oct. 19, 2011

Related U.S. Application Data

(60) Provisional application No. 61/394,872, filed on Oct. 20, 2010, provisional application No. 61/412,610, filed on Nov. 11, 2010.

(51) Int. Cl.
*H04R 25/00* (2006.01)
*H04R 9/08* (2006.01)
*H04R 1/02* (2006.01)

(52) U.S. Cl.
USPC ..... 381/313; 381/356; 381/387

(58) Field of Classification Search
USPC ..... 381/371, 73.1, 72, 71.1, 71.2, 71.4, 381/312–321, 23.1, 356, 387
See application file for complete search history.

(56) References Cited

PUBLICATIONS

[Boyd and Vandenberghe, Convex Optimization, Cambridge University Press, 7th ed., (2004), Chapter 11].*

Cox, H., et al., "Robust adaptive beamforming", IEEE Transactions on Acoustics, Speech and Signal Processing, 35(10), (Oct. 1987), 1365-1376.

Greenberg, J. E, et al., "Evaluation of an adaptive beamforming method for hearing aids", J Acoust Soc Am., 91(3), (Mar. 1992), 1662-76.

Hoshuyama, O., et al., "A robust adaptive beamformer for microphone arrays with a blocking matrix using constrained adaptive filters", IEEE Transactions on Signal Processing, 47(10), (Oct. 1999), 2677-2684.

Shewchuk, Jonathan Richard, "An Introduction to the Conjugate Gradient Method Without the Agonizing Pain", [Online]. Retrieved from the Internet: <URL: http://math.nyu.edu/faculty/greengar/painless-conjugate-gradient.pdf>, (Aug. 4, 1994), 64 pgs.

Stoica, P., et al., "Robust Capon beamforming", IEEE Signal Processing Letters, 10(6), (Jun. 2003), 172-175.

Vorobyov, S. A, et al., "Robust adaptive beamforming using worst-case performance optimization: a solution to the signal mismatch problem", IEEE Transactions on Signal Processing, 51(2), (Feb. 2003), 313-324.

* cited by examiner

*Primary Examiner* — Curtis Kuntz
*Assistant Examiner* — Sunita Joshi
(74) *Attorney, Agent, or Firm* — Schwegman Lundberg & Woessner, P.A.

(57) ABSTRACT

Disclosed herein, among other things, are methods and apparatus for improving speech intelligibility for speech-in-noise in audio processing and hearing assistance devices. The present subject matter includes a method for improving speech intelligibility for speech-in-noise for audio processing and hearing assistance devices. The method includes receiving an audio signal using a microphone array and processing the received signal to improve speech intelligibility in noise. A barrier-type beamforming process is used to improve signal-to-noise ratio at the output of the microphone array. The beamforming process includes convex optimization using a logarithmic barrier function, according to various embodiments.

20 Claims, 2 Drawing Sheets

EFFICIENT CONVEX OPTIMIZATION FOR REAL-TIME ROBUST BEAMFORMING WITH MICROPHONE ARRAYS

RELATED APPLICATIONS

The present application claims the benefit under 35 U.S.C. 119(e) of U.S. Provisional Patent Application Ser. No. 61/394,872, filed Oct. 20, 2010, and to U.S. Provisional Patent Application Ser. No. 61/412,610, filed Nov. 11, 2010, which are incorporated herein by reference in their entirety.

FIELD OF THE INVENTION

The present subject matter relates generally to audio processing devices and hearing assistance devices, and in particular to efficient convex optimization for real-time robust beamforming with microphone arrays.

BACKGROUND

For hearing aid users, speech-in-noise is one of the most difficult situations to deal with, because the noise deteriorates speech intelligibility. Several methods have been proposed to resolve this issue, but are complicated if the direction of the desired speech is not known, as efforts to reduce the noise can also inadvertently reduce the speech. This inadvertent reduction of the desired speed is called target cancellation and the direction of the desired speech is described by a vector called the steering vector.

Previous methods to resolve the speech-in-noise problem included estimating the steering vector or constraining the adaptation range to avoid target cancellation. The first class of methods that try to estimate the steering vector have significant shortcomings, because the steering vector of different subjects can differ significantly and the steering vector of a single subject is different every time the subject puts on the hearing aid. The second class of methods that limit the adaptation range also has shortcomings, because the limit of the adaptation reduces target cancellation but it also reduces benefit.

A third class of methods does not use a steering vector (indicating a specific target direction), but a range of steering vectors (indicating a target region) where the speech target can come from. This third class of methods uses fixed or adaptive beamforming algorithms (or static and adaptive) to improve the speech intelligibility in noise. Adaptive beamforming algorithms reduce the noise as much as possible with the constraint that sound coming from the target region is not attenuated. Adaptive beamforming algorithms have the highest potential to improve speech intelligibility. This third class of methods that protect the target region work well, but they have been designed for applications that include multiple sensors and that have the capacity for much more computational complexity than found in a hearing aid.

What is needed is an algorithm that does adaptive beamforming, is robust against steering vector mismatches and is computational feasible for a hearing aid.

SUMMARY

Disclosed herein, among other things, are methods and apparatus for improving speech intelligibility for speech-in-noise in audio processing and hearing assistance devices. The present subject matter includes a hearing assistance device having a microphone array configured to receive an audio signal, the audio signal including speech and noise. The hearing assistance device also includes a processor configured to process the received signal to improve speech intelligibility in noise. The processor is configured to use a barrier-type beamforming process to improve signal-to-noise ratio at the output of the microphone array. The beamforming process includes convex optimization using a logarithmic barrier function, according to various embodiments.

One aspect of the present subject matter includes a method for improving speech intelligibility for speech-in-noise for audio processing and hearing assistance devices. The method includes receiving an audio signal using a microphone array and processing the received signal to improve speech intelligibility in noise. A barrier-type beamforming process is used to improve signal-to-noise ratio at the output of the microphone array. The beamforming process includes convex optimization using a logarithmic barrier function, according to various embodiments.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
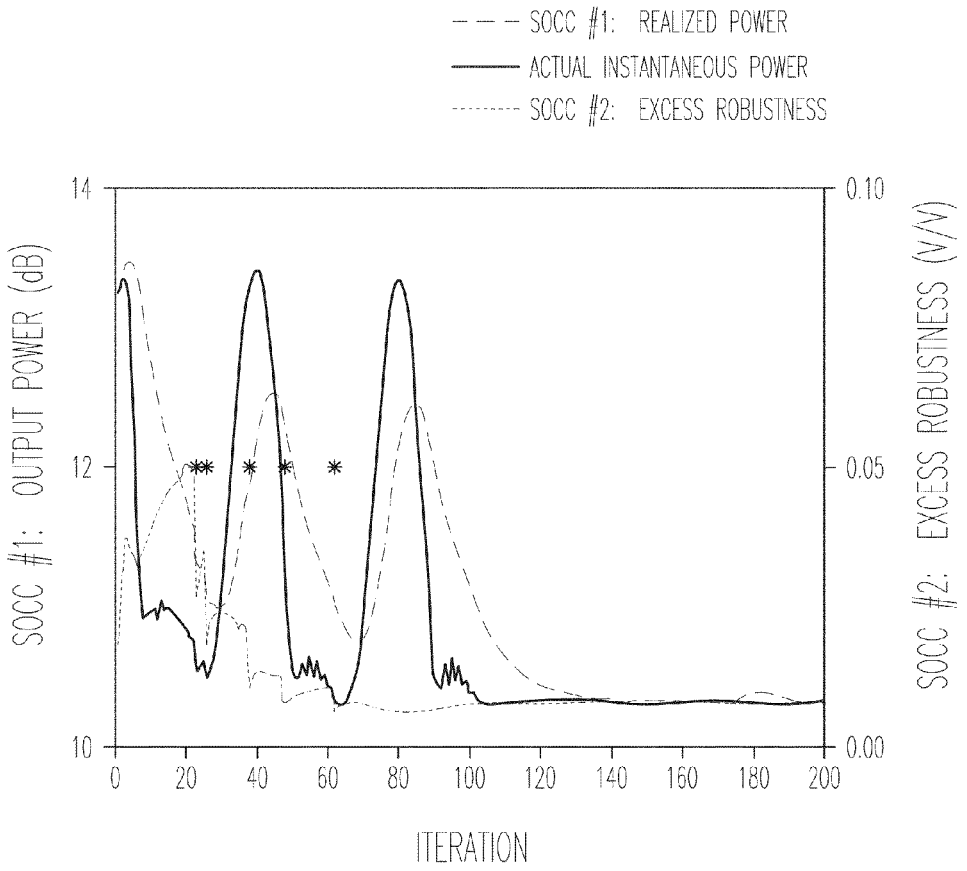
FIG. 1 illustrates a graphical representation showing elimination of interferer power, according to various embodiments of the present subject matter.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present subject matter presents an efficient implementation of a robust adaptive beamforming algorithm based on convex optimization for applications in the processing-constrained environment of a digital hearing aid. Several modifications of the standard interior point barrier method are introduced for use where the array correlation is changing rapidly relative to the algorithm's convergence rate. These efficiency improvements significantly simplify the computation without affecting the algorithm's fast convergence, and are useful for real-time adaptive beamforming regardless of the rate of array correlation change. Simulation results show that this implementation is numerically stable and succeeds where many minimum-variance distortionless response (MVDR) solutions fail.

1. INTRODUCTION

Although adaptive beamforming algorithms can improve the signal-to-noise ratio at the output of a microphone array [Cox et al., *IEEE Trans. Acoust., Speech, Signal Processing,* 35:1365 (1987)], they are not robust against any mismatch in the steering vector [Greenberg and Zurek, *J. Acoust. Soc. Am.,* 91:1662 (1992)]. Several methods have been proposed in the literature to resolve the steering mismatch issue [Hoshuyama et al., *IEEE Trans. Signal Processing,* 47:2677 (1999); Stoica et al., *IEEE Signal Processing Letters,* 10:172 (2003); Vorobyov et al., *IEEE Trans. Signal Processing,* 51:313 (2003)]. The first two papers estimate the steering vector in real-time as part of the adaptive beamforming algorithm and the third paper establishes a protected region around the steering vector where it allows no reduction.

For the hearing aid application, the estimation of the steering vector would be difficult, because the steering vector changes every time the wearer puts on the hearing aid and the steering vector can change when the wearer touches the hearing aid. Hence the method in [Vorobyov et al., 2003] is the most promising solution to solve the robustness problem of adaptive beamformers. It minimizes the output of the microphone array while maintaining a distortionless response for the worst case (mismatched) steering vector. Furthermore it derives a convex formulation for such a robust adaptive beamforming problem using second-order cone programming (SOCP) [Vorobyov et al., 2003]. The paper has, however, not been written with a hearing-aid application in mind: it neither takes into account the hearing aid's constraints on the computational complexity nor the ever-changing sound fields in which hearing aids are typically used, which results in time-varying data statistics and steering vectors. The present subject matter proposes efficient real-time convex optimization algorithms to solve the robust adaptive beamforming problem in a rapidly changing environment. It uses the barrier method with a logarithmic barrier function to solve the SOCP problem. The focus is on the balance among robustness, real-time adaptivity, and computational efficiency.

2. REAL-TIME ROBUST MVDR

Consider an MVDR beamformer that is robust against an arbitrary signal steering vector mismatch. The beamformer can be obtained by solving the following optimization problem [Vorobyov et al., 2003]

$$\min_{w} w^H R w \quad \text{subject to } |w^H a| \geq 1, \text{ for all } a \in A(\in) \tag{1}$$

where w is the beamformer, R is the data covariance matrix, a is the steering vector, and $A(\epsilon)$ is the uncertainty set of the steering vector.

Assume that the mismatch between the actual steering vector and the nominal one can be bounded by some known constant $\epsilon$. The uncertainty set can then be expressed as:

$$A(\epsilon)=\{a \mid a=a_0+\Delta, \|\Delta\| \leq \epsilon\}.$$

The problem in (1) is a nonconvex quadratic programming with infinitely many constraints and is thus computationally intractable. However, it has been shown in [Vorobyov et al., 2003] that (1) can be rewritten in the following equivalent convex form:

$$\begin{aligned} &\min_{w} w^H R w \\ &\text{subject to } w^H a \geq 1 \in \|w\| + 1 \\ &Im\{a^H w\} + 0 \end{aligned} \tag{2}$$

In (2), the objective is a quadratic form and a is the nominal steering vector. One can apply the Cholesky factorization $R=U^H U$ to obtain $w^H R w=\|Uw\|^2$. Thus minimizing the output power $w^H R w$ is equivalent to minimizing $\|Uw\|$. One can further introduce an additional variable, $\tau$, as an upper bound on $\|Uw\|$ and obtain:

$$\begin{aligned} &\min_{\tau, w} \tau \\ &\text{subject to } w^H a \geq 1 \in \|w\| + 1 \\ &\|Uw\| \leq \tau \\ &Im\{a^H w\} + 0 \end{aligned} \tag{3}$$

The problem in (3) has the standard form of an SOCP, and can be solved using a standard convex optimization solver such as SeDuMi [Sturm, "Using SeDuMi 1.02, a MATLAB toolbox for optimization over symmetric cones," http://citeseerx-.ist.psu.edu/viewdoc/summary?doi=10.1.1.49.6954, 1998].

In many real applications, the data covariance matrix R and steering vector a are time-varying. In such case, an SOCP needs be solved for each new pair of R and a. Solving each SOCP independently is very inefficient and not feasible, especially in embedded applications such as hearing aids where computational source is strictly limited. The next section presents an efficient real-time implementation of solving (2) for varying R and a using a improved logarithmic barrier method [Boyd and Vandenberghe, *Convex Optimization*, Cambridge University Press, 7th ed., (2004), Chapter 11].

2.1. Logarithmic Barrier

The logarithmic barrier method is used to solve the problem in (2). The barrier function that corresponds to the second-order cone constraint in (2) is:

$$\phi(w)=-\log((a^H w-1)^2-\epsilon^2\|w\|^2) \tag{4}$$

The idea of the logarithmic barrier method is to solve the following minimization problem with equality constraints only:

$$\begin{aligned} &\min_{w} w^H R w + (1/t)\phi(w) \\ &\text{subject to } Im\{w^H a\} = 0 \end{aligned} \tag{5}$$

where t is a parameter that sets the accuracy of the approximation of the inequality constraints by the barrier function $\phi(w)$. For fixed R and a, the optimal beamformer w can be solved by choosing large enough t.

For each fixed t, the barrier method uses Newton's method to solve (5). This requires both the gradient and the Hessian of the barrier function $\phi(w)$, which can be derived from the following corollary.

Corollary 1: Assume a logarithmic function of the form $$\phi(w) = -\log\left((c^T w + d)^2 - \|Aw + b\|^2\right) \tag{6}$$

Then its gradient, given in [Boyd and Vandenberghe, 2004, Chapter 11], and its derivative, the Hessian, can be expressed as:

$$\nabla\phi(w) = -2\frac{f(w)}{g(w)} \tag{7}$$

$$\nabla^2\phi(w) = -2g^{-2}(w)[g(w)(cc^T + A^T A) - 2f(w)f^T(w)] \in \Re^{N^2} \tag{8}$$

where $$f(w) = (c^T w + d)c - A^T(Aw + b)$$

$$g(w) = (c^T w + d)^2 - \|Aw + b\|^2$$

For example, for the SOCC in (3), $A = \epsilon I$, $b = 0$, $c = a$, and $d = -1$, with the real and imaginary components separated as in [Vorobyov et al., 2003].

2.2. Real-Time Implementation

This section presents an efficient real-time implementation for solving (2) in the scenario when both R and a are time-varying. Initialization consists of

- R is initialized to the first estimate given to the system
- w is initialized to be feasible; that is, it slightly exceeds the robustness constraint given E and a
- $\tau$ is initialized to meet the SOCC involving it from (3)
- x is the solution vector; it is initialized with the real and complex parts of w and with $\tau$
- t is initialized small value, which provides a gentle slope throughout the feasible region. (Higher t moves the gently sloping region closer to the edge of the feasible region and is suitable closer to convergence.)

At each iteration, which might be much less often than the sampling period, the following steps, which are an extension of the barrier method of [Boyd and Vandenberghe, 2004, Chapter 11], are taken:

1. Track environment change
   - Update R using a one-pole averaging filter
   - Adjust $\tau$ upward if needed to ensure the solution is feasible (meets all SOCCs)
2. Update t—If the root mean square change in x on the last iteration was less a specified threshold, increase t by a fixed percentage (next outer iteration of barrier method), unless the desired solution precision has already been reached. In practice, given slight restrictions on the desired precision and on the rate of change of R, it turns out that it is never necessary to decrease t to maintain stability.
3. Take the next step toward the optimum solution
   - Calculate the gradient and Hessian of $\phi(x)$
   - Construct the Newton system matrices
   - Solve the linear system for the update step using the conjugate gradient (CG) method
   - Update x by adding the update step to it 2.3. Efficiency Improvement A few efficiency improvements are obtained in the proposed algorithm when compared to the standard SOCP solver:

- Eliminating the Cholesky factorization: The problem formulation (3) requires the Cholesky factor U of R. But, the form (6) squares $\|Uw\|$, so calculating $w^H Rw$ directly suffices as suggested by (2), removing the computationally expensive Cholesky factorization.
- Iteration number reduction per update: The method above requires very few iterations per unit time to track changes in the environment. Even as R changes, the previous solution x provides an excellent basis for taking the next step. Simulations show that performing 20 iterations per second is sufficient to track somewhat rapidly moving signals given a 0.5 s time constant for the moving average filter.
- Truncating the CG method: The CG method is efficient for solving the linear systems in the barrier method. It iterates to the exact solution through a number of steps equal to the system order, with earlier steps making the most progress. Convergence is accelerated when eigen-values are clustered [Shewchuck, "An introduction to the conjugate gradient method without the agonizing pain," http://math.nyu.edu/faculty/greengar/painless-conjugate-gradient.pdf, 1994]. With M=3 microphones and the resulting system of order 6, truncating the solution after 3 iterations results in a negligible performance degradation across a wide range of inputs.
- Eliminating the linear constraint: The linear constraint $\mathrm{Im}\{a^H w\} = 0$ is used to eliminate a variable from the solution vector, which contains $\tau$ and the real and imaginary portions of w, resulting in a system of order 2M, where M is the number of microphones. This also eliminates a rank deficiency in the Hessian caused by the linear constraint. The variable elimination can be done without division if a is properly normalized.

3. EVALUATION

Three simulations illustrate the performance of the algorithm. For all simulations, three microphones in a uniform linear array measuring 1.5 cm from end-to-end with its axis in the 0° direction were used. The 2 kHz frequency band was simulated. A 10 dB target signal and a 10 dB interfering signal with 5° elevation and variable azimuth were used along with −40 dB of white noise in each mic. 20 iterations per second were performed and the averaging filter for R had a time constant of 0.5 s.

FIG. 1 shows that most of the interferer power is eliminated even for a rapidly moving interferer.

Figure 2:
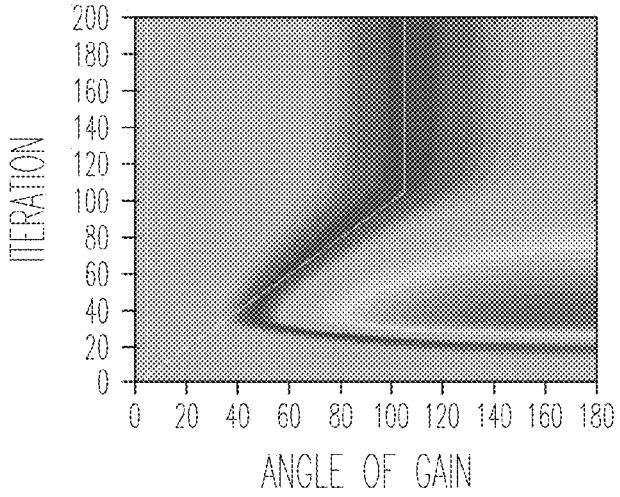
FIG. 2 illustrates a graphical representation showing response versus time for a slow moving interferer, according to one embodiment.

FIG. 2 shows the response vs. time for a more slowly moving interferer. The robustness constraint combined with the minimum power constraint keeps any null a sufficient angle away from the region that is guaranteed to have at least 0 dB gain. The null cannot move too close to this "protected" region without requiring a steep response to meet 0 dB at the region's edge, but a steep slope results in high white noise gain in the protected region, which is limited by the minimum power constraint.

Once the interferer moves sufficiently far from the protected region, the null begins tracking the interferer. Note that the successful illustrated null tracking occurs even though the source moves 1 degree per observation. Also, the algorithm only sees the source through the delay imposed by a single-pole time averaging filter that mixes in 10% of the current observation to estimate the true R.

For the early iterations, the maximum gain is at 180°, reaching a maximum of 15.5 dB at iteration 40 and surpassing 5.0 dB only between iterations 27 and 78. Per the constraint, the gain at 5° never goes below 0 dB; it reaches a maximum of 1.2 dB at iteration 38.

Figure 3:
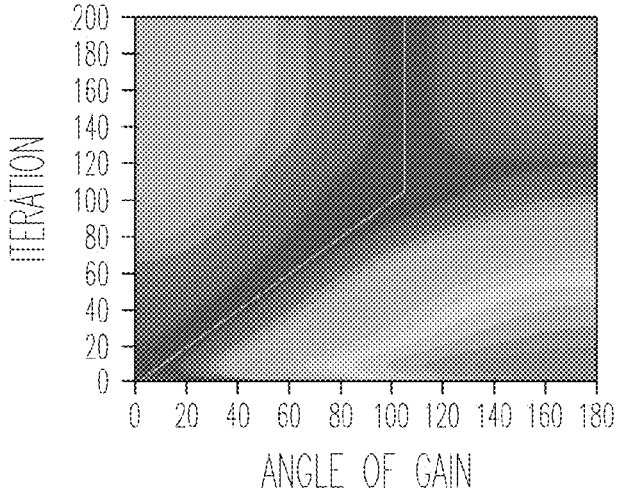
FIG. 3 illustrates a graphical representation filter directional response versus simulation iteration for a non-robust case, according to one embodiment.

FIG. 3 shows a simulation of a standard implementation with no protection and a 5° steering vector mismatch. This allows signal nulling, which persists at −17 dB after iteration 20, −11 dB after iteration 40, and −7 dB after iteration 60, −3 dB after iteration 80, and −1 dB after iteration 100.

Taking advantage of the most obvious sparseness of the system, the Hessian can be calculated for three microphones with 230 multiplies, 148 adds, and 2 divisions. Solving the system for three microphones using the truncated CG method takes about 188 multiplies and adds and exactly 5 divisions. These are the most expensive operations and drive the cost of the algorithm. Using historical algorithm overhead estimates, 91% of the processor time would be required to run the given method in 16 bands on a currently shipping digital hearing aid. Given everything else the hearing aid must process, this is not yet feasible, but it should soon be given increasing computational rates.

4. CONCLUSIONS

The present subject matter illustrates that the barrier method of solving an SOCP problem is well suited to adaptive acoustic beamforming with robustness to steering vector uncertainty. The method can be implemented with low computational complexity approaching the available processing power in current hearing aids. Furthermore, the barrier method has been adapted to solve a continually changing problem to sufficient precision instead of solving a static problem to great precision as is the common case. Several other techniques to minimize the computational complexity have been applied. Simulations show that the method can adapt quickly even when the interferer moves rapidly. Also, the results are robust to a user-specified level of steering vector mismatch.

The present subject matter is demonstrated for hearing aids. It is understood however, that the disclosure is not limited to hearing aids and that the teachings provided herein can be applied to a variety of audio processing and hearing assistance devices, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method, comprising:

receiving an audio signal using a microphone array in a hearing assistance device; and processing the received signal to improve speech intelligibility in noise, including using a barrier-type beamforming process to improve signal-to-noise ratio at the output of the microphone array function and using a level of steering vector mismatch to adapt computational complexity, wherein the beamforming process includes convex optimization using a logarithmic barrier, and wherein the beamforming process is adapted to execute on a processor of the hearing assistance device by eliminating a linear constraint, truncating a conjugate gradient method, or eliminating a Cholesky factorization.

2. The method of claim 1, wherein using the logarithmic barrier function includes solving a minimization problem with equality constraints.

3. The method of claim 2, wherein using the logarithmic barrier function includes using Newton's method to solve the minimization problem.

4. The method of claim 3, wherein using Newton's method includes using a gradient and a Hessian of the barrier function.

5. The method of claim 3, wherein using Newton's method includes constructing Newton system matrices.

6. The method of claim 3, wherein using Newton's method includes solving a linear system for an update step using a conjugate gradient method.

7. The method of claim 1, wherein using the barrier-type beamforming process includes using fewer iterations than sampling periods.

8. The method of claim 1, wherein using the barrier-type beamforming process includes tracking environment change.

9. The method of claim 5, wherein tracking environment change includes updating the data covariance matrix using a one-pole averaging filter.

10. The method of claim 1, wherein using the barrier-type beamforming process includes performing multiple iterations to reach a desired solution precision.

11. A hearing assistance device, comprising:

a microphone array configured to receive an audio signal, the audio signal including speech and noise; and a processor configured to process the received signal to improve speech intelligibility in noise, wherein the processor is configured to use a barrier-type beamforming process to improve signal-to-noise ratio at the output of the microphone array function and to use a level of steering vector mismatch to adapt computational complexity, wherein the beamforming process includes convex optimization using a logarithmic barrier, and wherein the beamforming process is adapted to execute on the processor of the hearing assistance device by eliminating a linear constraint, truncating a conjugate gradient method, or eliminating a Cholesky factorization.

12. The device of claim 11, wherein the hearing assistance device includes a hearing aid.

13. The device of claim 12, wherein the hearing aid includes a behind-the-ear (BTE) hearing aid.

14. The device of claim 12, wherein the hearing aid includes an in-the-ear (ITE) hearing aid.

15. The device of claim 12, wherein the hearing aid includes an in-the-canal (ITC) hearing aid.

16. The device of claim 12, wherein the hearing aid includes a receiver-in-canal (RIC) hearing aid.

17. The device of claim 12, wherein the hearing aid includes a completely-in-the-canal (CIC) hearing aid.

18. The device of claim 12, wherein the hearing aid includes a receiver-in-the-ear (RITE) hearing aid.

19. The device of claim 11, wherein the hearing assistance device includes a cochlear implant.

20. The device of claim 11, wherein the hearing assistance device includes a deep insertion device.

* * * * *